US011414826B2

(12) United States Patent
Zhu et al.

(10) Patent No.: US 11,414,826 B2
(45) Date of Patent: Aug. 16, 2022

(54) SYSTEM AND METHOD FOR SEALING EXPANDED POLYMER-BASED PILE SHOES FOR JACKET

(71) Applicant: ZHEJIANG UNIVERSITY, Zhejiang (CN)

(72) Inventors: Ronghua Zhu, Zhejiang (CN); Fuming Wang, Zhejiang (CN); Xiang Sun, Zhejiang (CN); Hengfeng Wang, Zhejiang (CN); Qingfu Xu, Zhejiang (CN)

(73) Assignee: ZHEJIANG UNIVERSITY, Zhejiang (CN)

( * ) Notice: Subject to any disclaimer, the term of this patent is extended or adjusted under 35 U.S.C. 154(b) by 0 days.

(21) Appl. No.: 17/243,598

(22) Filed: Apr. 29, 2021

(65) Prior Publication Data

US 2021/0404136 A1 Dec. 30, 2021

(30) Foreign Application Priority Data

Jun. 24, 2020 (CN) ..... 202010589339.5

(51) Int. Cl.

| | |
|---|---|
| ***E02B 17/02*** | (2006.01) |
| ***E02D 27/52*** | (2006.01) |
| ***E02D 5/72*** | (2006.01) |
| ***E02D 7/02*** | (2006.01) |

(Continued)

(52) U.S. Cl.

CPC ..... *E02B 17/027* (2013.01); *E02D 5/72* (2013.01); *E02D 7/02* (2013.01); *E02D 27/425* (2013.01); *E02D 27/44* (2013.01); *E02D 27/525* (2013.01); *E02D 2250/003* (2013.01); *E02D 2250/0061* (2013.01); *E02D 2300/002* (2013.01); *E02D 2300/0006* (2013.01); *E02D 2450/10* (2013.01)

(58) Field of Classification Search

CPC ..... E02B 17/02; E02B 17/027; E02D 27/52; E02D 27/525

USPC ..... 405/227

See application file for complete search history.

(56) References Cited

U.S. PATENT DOCUMENTS 3,533,241 A * 10/1970 Richardson ..... E02B 17/0013 277/606

4,024,723 A * 5/1977 Mayfield ..... E02B 17/0008 166/187

(Continued)

FOREIGN PATENT DOCUMENTS

CN 110511340 11/2019

*Primary Examiner* — Frederick L Lagman

(74) *Attorney, Agent, or Firm* — JCIP Global Inc.

(57) ABSTRACT

The present invention belongs to the technical field of offshore wind power construction and particularly relates to a system and a method for sealing expanded polymer-based pile shoes for a jacket. The system comprises a jacket disposed on a seabed, several pile shoes arranged around a lower end of the jacket, and several steel pipe piles inserted into the seabed, wherein the steel pipe piles are inserted into the corresponding pile shoes. The system is characterized in that gaps between the pile shoes and the steel pipe piles are respectively filled with concrete and an expanded high polymer from top to bottom, an annular elastic diaphragm is further connected to the inner walls of the pile shoes, and the expanded polymer is wrapped by the elastic diaphragm, such that the expanded polymer is isolated from the steel pipe piles and the concrete.

10 Claims, 4 Drawing Sheets

(51) Int. Cl.
*E02D 27/42* (2006.01)
*E02D 27/44* (2006.01)

(56) References Cited

U.S. PATENT DOCUMENTS 4,077,224 A * 3/1978 Coone ..... E02B 17/0008
405/225
4,087,978 A * 5/1978 Landers ..... E02B 17/0013
405/227
4,184,790 A * 1/1980 Bassett ..... E02B 17/0008
405/227
4,230,424 A * 10/1980 Sullaway ..... E02B 17/0013
405/227
4,412,759 A * 11/1983 Britton ..... E02B 17/0008
405/227
4,422,805 A * 12/1983 Sweatman ..... E02B 17/0008
405/222
4,552,486 A * 11/1985 Knox ..... E02D 5/62
405/227
4,902,170 A * 2/1990 Knox ..... E02D 5/62
405/227
4,968,184 A * 11/1990 Reid ..... E02B 17/0008
405/195.1
5,028,171 A * 7/1991 Gray ..... E02B 17/0008
405/227

* cited by examiner

SYSTEM AND METHOD FOR SEALING EXPANDED POLYMER-BASED PILE SHOES FOR JACKET

CROSS-REFERENCE TO RELATED APPLICATION

This application claims the priority benefit of China application serial no. 202010589339.5, filed on Jun. 24, 2020. The entirety of the above-mentioned patent application is hereby incorporated by reference herein and made a part of this specification.

BACKGROUND

Technical Field

The present invention belongs to the technical field of offshore wind power construction, and in particular relates to a system and a method for sealing expanded polymer-based pile shoes for a jacket.

Description of Related Art

An offshore wind turbine and a booster station are located in a severe marine environment and a foundation of the offshore wind turbine and the booster station not only bears a load from an upper portion of a cushion cap, but also resists a huge environmental load. Thus, it is quite strict in demand on structure and construction process, so that the stability and the safety of a marine platform are guaranteed.

The offshore wind turbine has many different structural styles, including gravity type, single pile type, suction type, tri-pile (multi-pile) jacket type, floating type and the like. A jacket foundation is wider to apply, ranking only second to the single pile type. It is wider to apply a foundation form of the offshore booster station which also adopts the jacket. The jacket foundation is of a spatial frame type structure which has the advantages of being small in rod diameter, high in strength, light in weight, small in wave flow action and suitable for a deeper sea area. The jacket foundation can be divided into two structural forms according to a construction sequence: a pre-piled jacket and a post-piled jacket. The two jacket forms are same in main body structure. It is unnecessary to arrange the pile shoes at the tail ends of supporting legs of the pre-piled jacket and the pile shoes are arranged at the tail ends of supporting legs of the pre-piled jacket.

In post pile method construction, the post-piled jacket is adopted. In the construction process, it is necessary to place the jacket foundation on a seabed surface first, the bottoms of the pile shoes are in contact with a mud surface, then, the steel pipe piles penetrate through the pile shoes to be driven into the seabed, the pile shoes and the steel pipe piles are of circular ring columnar structures, the inner diameters of the pile shoes are greater than the outer diameters of the steel pipe piles, and the pile shoes and the steel pipe piles are connected through a grouting material such as concrete. Thus, loads such as the upper portion of the jacket cushion cap, waves and ocean currents can be transferred to the steel pipe piles through the grouting material by way of the pile shoes, and then the steel pipe piles then transfer the loads to the seabed, such that the structural strength and stability of an offshore wind power structure are guaranteed.

Jacket grouting is a key technology of construction of a whole wind power basic structure. Whether grouting is successful or not has the direct bearing on ability of an offshore wind power basic structure resisting an environmental load and service life of the offshore wind power basic structure. As the pile shoes and the pipe piles of the jacket are different in diameter, annular gaps exist between the pile shoes and the pipe piles. The grouting materials is used for filling the annular gaps to guarantee that the loads are transferred to the steel pipe piles through the pile shoes and finally, forces are transferred to the seabed.

In order to prevent leakage of slurry in the grouting process, it is necessary to block the bottoms of the annular spaces, i.e., the bottoms of the pile shoes of the jackets are sealed. At present, there are two popular sealing methods: air bag sealing: the working principle of air bag sealing comprises mounting a sealed air bag at the bottom of each pile shoe and mounting an air pressure transmission pipeline, then, closing the annular spaces between the pile shoes and the steel pipe piles after the air bags are inflated to expand by using air pressure equipment after mounting, positioning and piling the jackets, and finally, carrying out grouting; mechanical sealing: the method comprises mounting a sealing strip such as a rubber sheet or a steel plate at the bottom of the pile shoe by way of bolt connection or welding, wherein after the steel pipe pile penetrates through the sealing strip, a pile body and the sealing strip extrude each other and are in tight contact to generate a frictional force to resist a pressure of the grouting solution and seawater to the sealing strip during grouting. One or two sealing strips can be mounted.

Although the above two methods are popular, complete sealing cannot be ensured. In the construction process, the grouting solution is easy to leak from the bottom of the pile shoe and seawater is easy to permeate, so that the resource waste is caused and the construction cost is increased. Meanwhile, the seawater is be mingled with much fine sand which is easy to enter the closed space through the gaps between the pile shoes and the steel pipe piles to affect the leakproofness.

SUMMARY

In order to overcome defects in the prior art, the invention provides a technical scheme of a system and a method for sealing expanded polymer-based pile shoes for a jacket in a post-pile method construction process.

The system for sealing expanded polymer-based pile shoes for the jacket includes a jacket disposed on a seabed, several pile shoes arranged around a lower end of the jacket and several steel pipe piles inserted into the seabed, the steel pipe piles being inserted into the corresponding pile shoes, wherein the system is characterized in that gaps between the pile shoes and the steel pipe piles are respectively filled with concrete and expanded polymer from top to down, an annular elastic diaphragm is further connected to an inner wall of the pile shoes, and the expanded polymer is wrapped by the elastic diaphragm, such that the expanded polymer is isolated from the steel pipe piles and the concrete.

The system for sealing expanded polymer-based pile shoes for the jacket, characterized in that a first sealing partitioning strip and a second sealing partitioning strip are arranged between each pile shoe and each steel pipe pile from top to bottom, the first sealing partitioning strip and the second sealing partitioning strip partition the gap between the pile shoe and the steel pipe pile into a first annular chamber and a second annular chamber, the first annular chamber is filled with the concrete, and the expanded polymer and the elastic diaphragm are arranged in the second annular chamber.

The system for sealing expanded polymer-based pile shoes for the jacket, characterized in that a sand-preventing diaphragm is arranged at a bottom of each pile shoe, and the steel pipe pile is inserted into the seabed after perforating the sand-preventing diaphragm.

The system for sealing expanded polymer-based pile shoes for the jacket, characterized in that a bottom cover is fixedly matched with the bottom of the pile shoe, and the sand-preventing diaphragm is clamped between the pile shoe and the bottom cover.

The system for sealing expanded polymer-based pile shoes for the jacket, characterized in that a grouting pipe for grouting the expanded polymer is arranged on a side portion of the pile shoe.

The method for sealing expanded polymer-based pile shoes for the jacket, the method includes the steps of:

step S1, mounting the annular elastic diaphragm on an inner wall of each pile shoe;

step S2, disposing the jacket on the seabed, inserting the steel pipe pile into the pile shoe and then driving a lower end of the steel pipe pile into the seabed;

step S3, grouting the expanded polymer between the inner wall of the pile shoe and the elastic diaphragm, wherein the expanded polymer wrapped by the elastic diaphragm expands, such that a barrier formed by the expanded polymer and the elastic diaphragm is formed between the pile shoe and the steel pipe pile; and step S4, grouting concrete grout between the pile shoe and the steel pipe pile and above the expanded polymer, wherein the pile shoe and the steel pipe pile are fixedly connected after the concrete grout is solidified, thereby completing the installation of the jacket foundation.

The method for sealing expanded polymer-based pile shoes for the jacket, characterized in that in the step S1, a first sealing partitioning strip and a second sealing partitioning strip are further arranged on the inner wall of the pile shoe and are respectively located at the upper and lower ends of the elastic diaphragm, the two sealing partitioning strips partition a gap between the pile shoe and the steel pipe pile into a first annular chamber and a second annular chamber; in the step S2, the inner ends of the two elastic diaphragms are tightly attached to the steel pipe pile after the steel pipe pile is inserted into the pile shoe; in the step S3, the expanded polymer is grouted into the second annular chamber; and in the step S4, the concrete grout is grouted into the first annular chamber.

The method for sealing expanded polymer-based pile shoes for the jacket, characterized in that in the step S1, a sand-preventing diaphragm is arranged at the bottom of the pile shoe, and in the step S2, the steel pipe pile perforates the sand-preventing diaphragm when being inserted into the pile shoe.

The method for sealing expanded polymer-based pile shoes for the jacket, characterized in that the side wall of the pile shoe is provided with a grouting pipe for grouting the expanded polymer, and the expanded polymer extrudes residual seawater from the second annular cavity through the grouting pipe on the side wall of the pile shoe while expanding underwater.

The method for sealing expanded polymer-based pile shoes for the jacket, characterized in that the jacket is leveled after the steel pipe pile is driven into the seabed, and then the method proceeds to the step S3.

Compared with the prior art, according to the present invention, the elastic diaphragms and the expanded polymer are combined to seal the bottoms of the pile shoes, such that the safety of construction of an offshore wind power jacket foundation can be guaranteed and it is guaranteed that an offshore wind turbine and a booster station are enough in strength to resist loads.

DESCRIPTION OF THE EMBODIMENTS

The present invention will be further elaborated hereafter in connection with the drawings.

Figure 1:
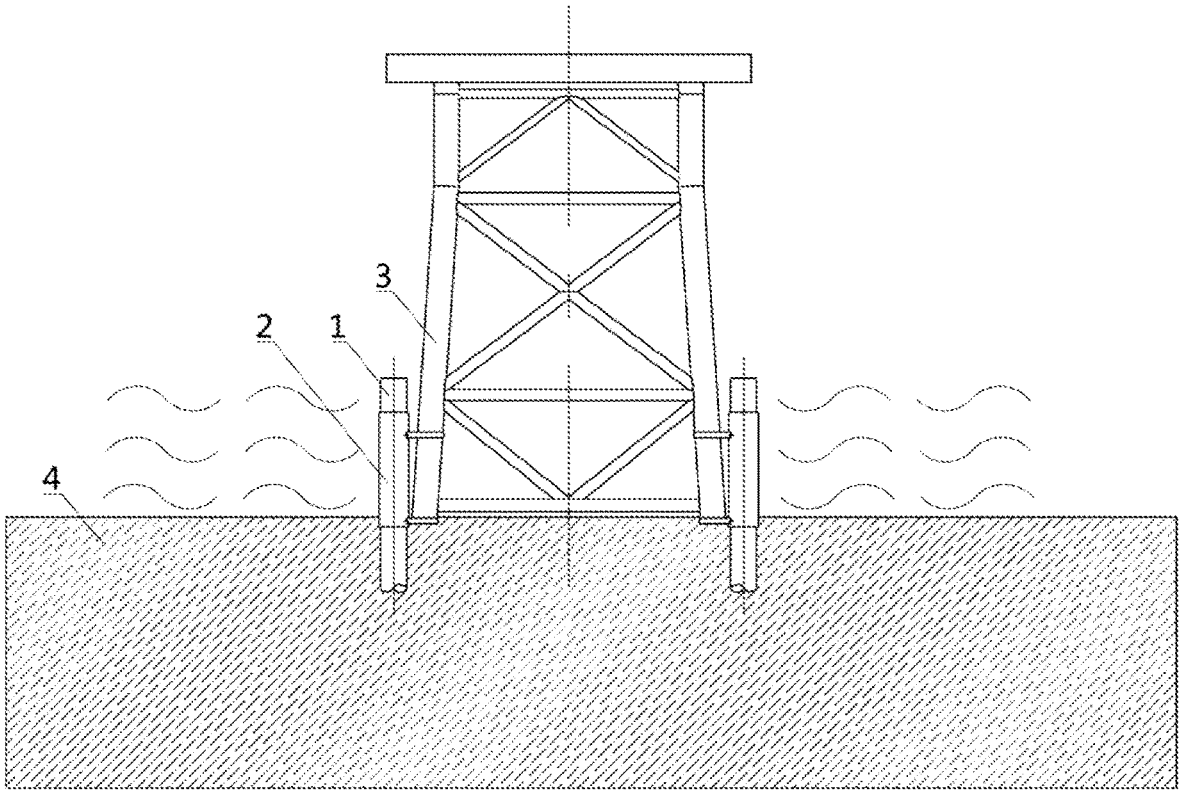
FIG. 1 is a structural schematic diagram of the system for sealing pile shoes for the jacket of the present invention.
Figure 2:
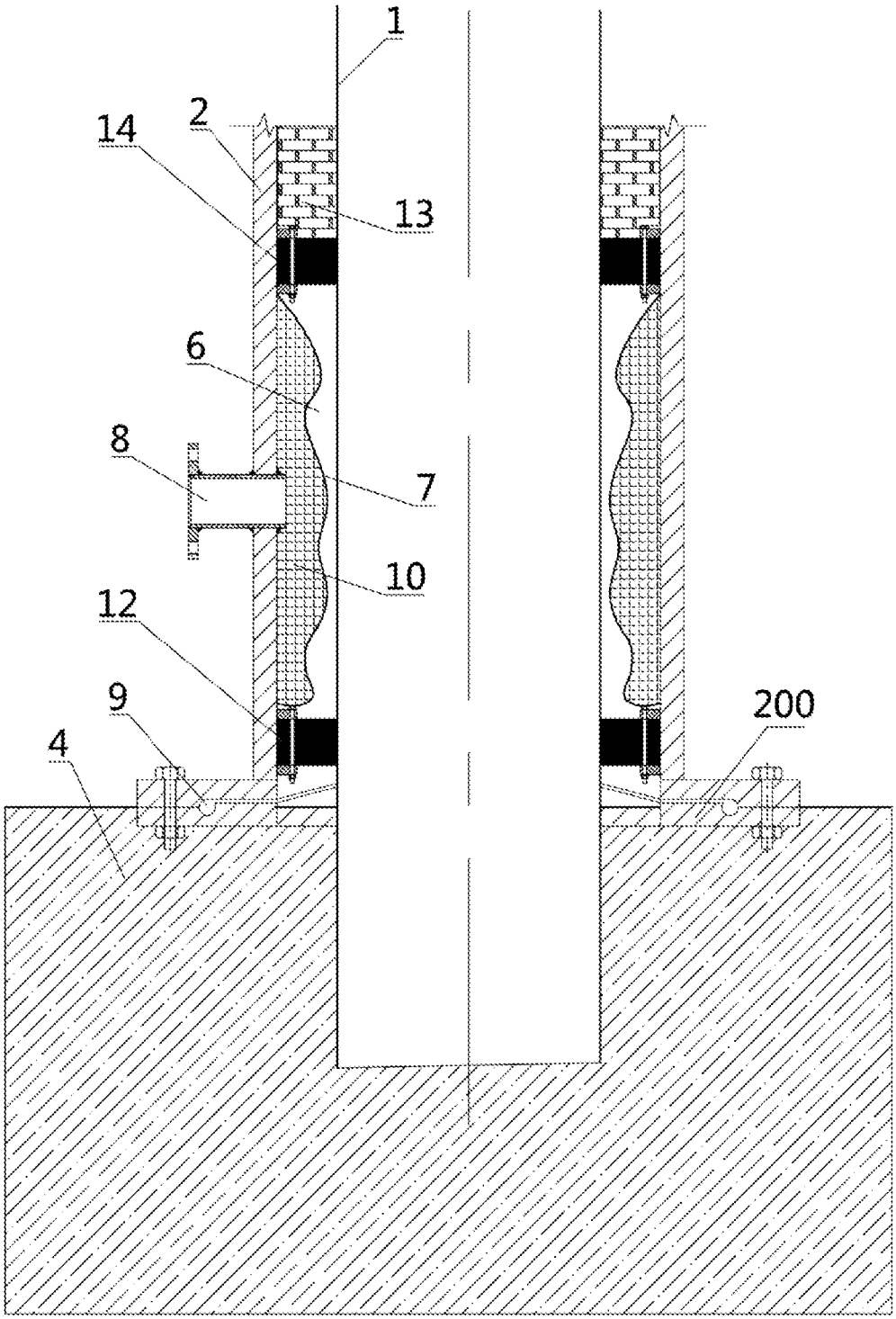
FIG. 2 is one of local structural schematic diagrams of the system for sealing pile shoes for the jacket of the present invention.
Figure 3:
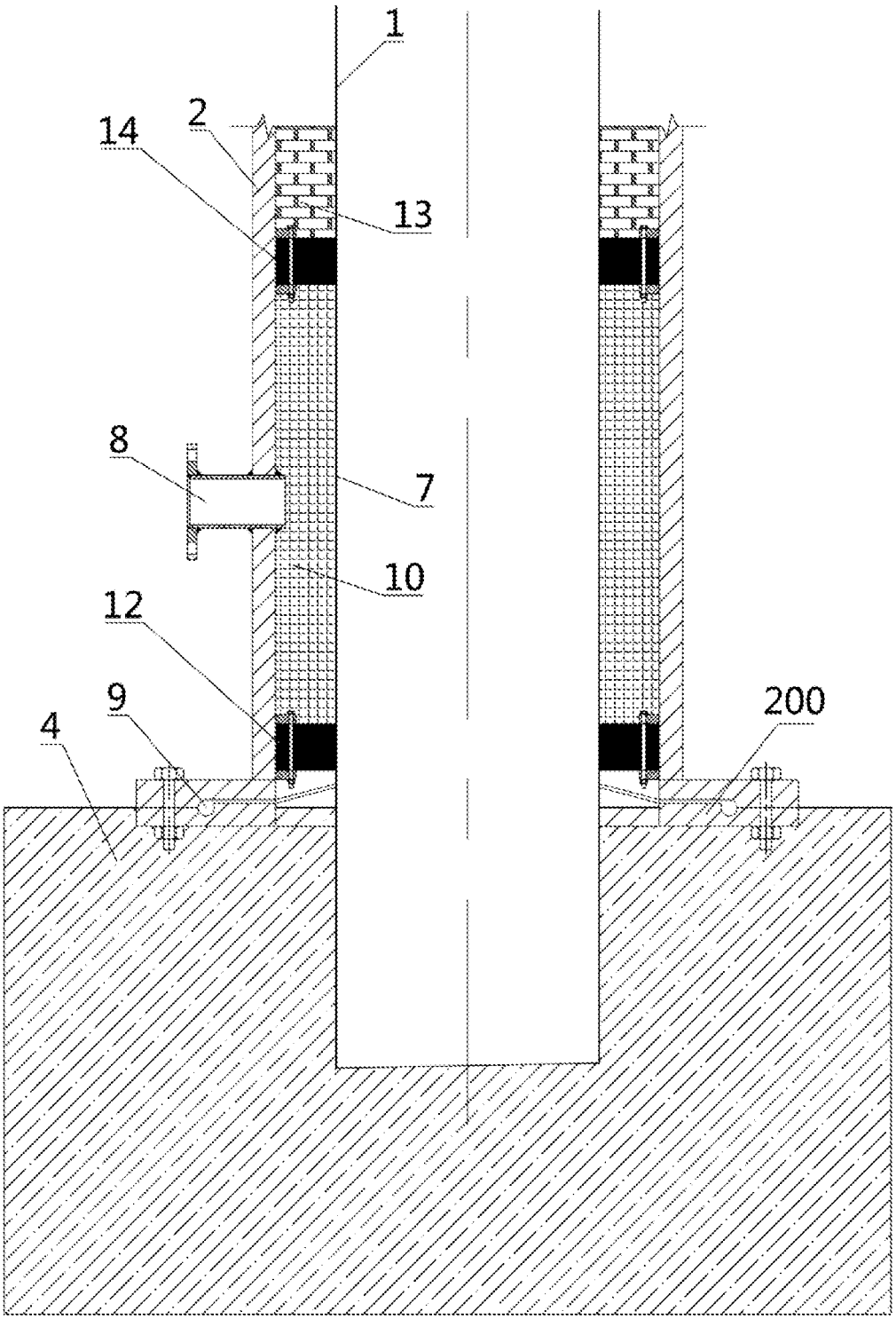
FIG. 3 is another local structural schematic diagram of the system for sealing pile shoes for the jacket of the present invention.
Figure 4:
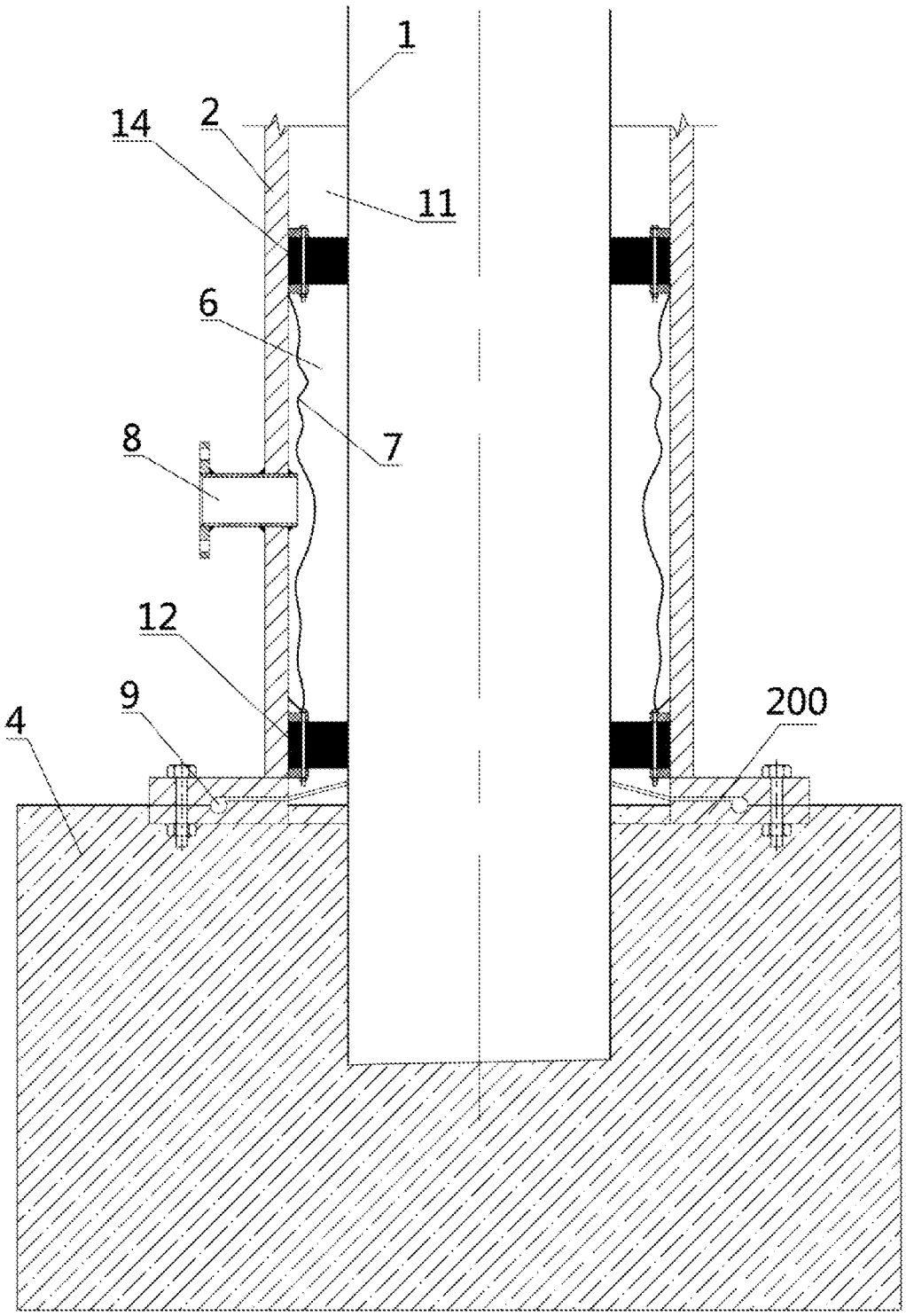
FIG. 4 is yet another local structural schematic diagram of the system for sealing pile shoes for the jacket of the present invention.

As shown in the FIG. 1 to FIG. 4, the system for sealing expanded polymer-based pile shoes for the jacket includes a jacket 3 disposed on a seabed 4, several pile shoes 2 arranged around a lower end of the jacket 3 and several steel pipe piles 1 inserted into the seabed 4, the steel pipe piles 1 being inserted into the corresponding pile shoes 2. Gaps between the pile shoes 2 and the steel pipe piles 1 are respectively filled with concrete 13 and an expanded polymer 10 from top down, an annular elastic diaphragm 7 is further connected to an inner wall of the pile shoe 2, and the expanded polymer 10 is wrapped by the elastic diaphragm 7, such that the expanded polymer 10 is isolated from the steel pipe piles 1 and the concrete 13.

As an optimization, a first sealing partitioning strip 14 and a second sealing partitioning strip 12 are arranged from top bottom between each pile shoe 2 and each steel pipe pile 1, the first sealing partitioning strip 14 and the second sealing partitioning strip 12 partition the gap between the pile shoe 2 and the steel pipe pile 1 into a first annular chamber 11 and a second annular chamber 6, the first annular chamber 11 is filled with the concrete 13 and the expanded polymer 10 and the elastic diaphragms 7 are arranged in the second annular chamber 6.

In the above structure, the first sealing partition strip 14 and the second sealing partition strip 12 are of annular structures, and both the first sealing partition strip 14 and the second sealing partition strip 12 are fixed to the inner wall of the pile shoe 2 through bots and are welded to the inner wall of the pile shoe 2. The inner ends of the two sealing strips are tightly attached to the outer wall of the steel pipe pile 1.

As an optimization, the sand-preventing diaphragm 9 is arranged at a bottom of each pile shoe 2, and the steel pipe pile 1 is inserted into the seabed 4 after perforating the sand-preventing diaphragm 9.

In the above structure, a bottom cover 200 is fixedly matched with the bottom of the pile shoe 2, and the sand-preventing diaphragm 9 is clamped between the pile shoe 2 and the bottom cover 200.

As an optimization, a grouting pipe 8 for grouting the expanded polymer 10 is arranged on a side portion of the pile shoe 2.

The method for sealing expanded polymer-based pile shoes for the jacket, the method including the steps of step S1, mounting the annular elastic diaphragm 7 on an inner wall of each pile shoe 2;

step S2, disposing the jacket 3 on the seabed 4, wherein at the time, the pile shoe 2 is inundated with seawater, inserting the steel pipe pile 1 into the pile shoe 2 and then driving a lower end of the steel pipe pile 1 into the seabed 4;

step S3, grouting the expanded polymer 10 between the inner wall of the pile shoe 2 and the elastic diaphragm 7, wherein the expanded polymer 10 wrapped by the elastic diaphragm 7 expands, such that a barrier formed by the expanded polymer 10 and the elastic diaphragm 7 is formed between the pile shoe 2 and the steel pipe pile 1; and step S4, grouting concrete grout between the pile shoe 2 and the steel pipe pile 1 and above the expanded polymer 10, wherein the pile shoe 2 and the steel pipe pile 1 are fixedly connected after the concrete grout is solidified. Thus, loads such as the upper portion of the jacket cushion cap, waves and ocean currents can be transferred to the steel pipe piles 1 through the grouting material by way of the pile shoes 2, and then the steel pipe piles 1 then transfer the loads to the seabed 4, such that the structural strength and stability of an offshore wind turbine and the booster station are guaranteed, thereby completing the installation of the jacket foundation.

As an optimization, in the step S1, an upper edge and a lower edge of each elastic diaphragm 7 are compressed to the inner wall of the pile shoe 2 through pressing plates, separately, such that the upper edge and the lower edge of the elastic diaphragm 7 are sealed tightly.

As an optimization, in the step S1, a first sealing partitioning strip 14 and a second sealing partitioning strip 12 are further arranged on the inner wall of the pile shoe 2 and are respectively located at the upper and lower ends of the elastic diaphragm 7, the two sealing partitioning strips partition a gap between the pile shoe 2 and the steel pipe pile 1 into a first annular chamber 11 and a second annular chamber 6; in the step S2, the inner ends of the two elastic diaphragms are tightly attached to the steel pipe pile 1 after the steel pipe pile 1 is inserted into the pile shoe 2; in the step S3, the expanded polymer 10 is grouted into the second annular chamber 6; and in the step S4, the concrete grout is grouted into the first annular chamber 11, the first annular chamber 11 is inundated with the concrete grout, and the seawater in the pile shoe 2 is drained.

In the sealing method, the side wall of the pile shoe 2 is provided with the grouting pipe 8 for grouting the expanded polymer 10. In specific operation, the grouting pipe 8 is grouted by using pressure grouting equipment such as a pump, and the expanded polymer extrudes residual seawater from the second annular cavity 6 through the grouting pipe 8 on the side wall of the pile shoe 2 while expanding underwater.

As an optimization, in the step S1, the sand-preventing diaphragm 9 is arranged at the bottom of the pile shoe 2, and the diaphragm 9 is a first line of defense for preventing sediment from entering the pile shoe 2; and in the step S2, when the steel pipe pile 1 in inserted into the pile shoe 2, the steel pipe pile 1 perforates the sand-preventing diaphragm 9.

As an optimization, the jacket 3 is leveled after the steel pipe pile 1 is driven into the seabed 4, and then the method proceeds to the step S3.

In the above sealing method, on a land, the sand-preventing diaphragm 9, an elastic fabric 7 and two sealing partition strips are arranged at the bottom of the pile shoe 2 first, the diaphragm 9 is a first line of defense for preventing sediment from entering the pile shoe 2, after the steel pipe pile 1 is driven into the pile shoe 2, the sand-preventing diaphragm 9 is broken, the initial state of the elastic fabric 7 is that the elastic fabric 7 is tightly attached to the inner wall of the pile shoe 2, such that the elastic fabric 7 is prevented from being broken in subsequent piling, and the sealing partition strips play a role of preventing sediment from entering the second annular chamber 6 and preventing the concrete grout from leaking from the first annular chamber 11 during grouting. In the piling process, the steel pipe pile 1 is rubbed with the partitioning strips severely, such that the partitioning strips have a risk of being damaged. Therefore, the elastic fabric 7 and the expanded polymer 10 play a critical security role of sealing and blocking. The side wall of the pile shoe 2 is provided with a plurality of grouting pipes 8 for grouting the expanded polymer 10 into the elastic fabric 7. After the jacket 3 is leveled and piled, the first annular chamber 11 and the second annular chamber 6 are formed between the pile shoe 2 and the steel pipe pile 1. At the time, the expanded polymer 10 is grouted into the elastic fabric 7 from the grouting pipes 8, and the expanded polymer 10 expands in the elastic fabric 7. Along with increase of injection amount of the expanded polymer 10, the elastic fabric 7 is filled fully slowly, and at the time, the state is as shown in the FIG. 2. After the expanded polymer 10 is injected and expands, the elastic fabric 7 inundated with the expanded polymer 10 fills the second annular chamber 6 fully, and at the time, the state is as shown in the FIG. 3. In the grouting and blocking process, residual water in the second annular chamber 6 are further drained from another several holes in the side wall of the pile shoe 2, and thus, the second annular chamber 6 is in totally closed state. Guaranteed by the elastic fabric 7 and the expanded polymer 10, the concrete grout is not leaked from the bottom, and the seawater cannot permeate into the first annular chamber 11 from the bottom, and then grouting is carried out, such that the pile shoe 2 and the steel pipe pile 1 are connected fixedly to complete installation of the offshore wind power jacket foundation.

The elastic fabric in the present invention can be materials, for example geotechnical cloth or rubber, with advantages of high strength, corrosion resistance, good antimicrobial property and the like, and full strength and elongation can be kept in a wet and dry state.

The expanded polymer of the present invention is the prior art. The expanded polymer is specifically made from a high strength polyurethane material disclosed by a Chinese patent with the publication number CN 110511340 A. In addition, the expanded polymer can be made from other materials with a same function.

Compared with a conventional method, the present invention has the advantages and innovation points below:

1. Grouting and sealing between the pile shoes and the steel pipe piles of the jacket foundation are carried out by means of a method of combining the expanded polymer with the elastic fabric, wherein good sealing effect and blocking effect are obtained.

2. The sand-preventing diaphragm is mounted at the bottom of the pile shoe to provide a first barrier for preventing sediment from entering the grouting space.

3. The expanded polymer has a very good quick cementing property. If the fine sand enters into the annular space between the pipe pile and the pile shoe through the gap, the fine sand can be cemented integrally quickly by the material, such that the leakproofness is guaranteed.

4. The elastic fabric has the advantages of high strength, corrosion resistance, good antimicrobial property and the like, guarantees better durability in the marine environment, and can keep full strength elongation in the dry and wet state. As the expanded polymer expands in the elastic fabric, the material is not damaged and is an ideal hermetic grouting material. By adopting the elastic fabric, installation of a steel wire hairbrush and the sealing partitioning strips in an earlier stage can be avoided, so that the cost and the construction difficulty are reduced and the construction efficiency is improved.

5. The present invention is wider in application range and can be applied to either the jacket foundation of the offshore wind turbine or the jacket foundation of the booster station.

At last, it should be stated that the above various embodiments are only used to illustrate the technical solutions of the present invention without limitation; and despite reference to the aforementioned embodiments to make a detailed description of the present invention, those of ordinary skilled in the art should understand: the described technical solutions in above various embodiments may be modified or the part of or all technical features may be equivalently substituted; while these modifications or substitutions do not make the essence of their corresponding technical solutions deviate from the scope of the technical solutions of the embodiments of the present invention.

What is claimed is:

1. A system for sealing expanded polymer-based pile shoes for a jacket, comprising a jacket (3) disposed on a seabed (4), several pile shoes (2) arranged around a lower end of the jacket (3) and several steel pipe piles (1) inserted into the seabed (4), the steel pipe piles (1) being inserted into the corresponding pile shoes (2), wherein the system is characterized in that gaps between the pile shoes (2) and the steel pipe piles (1) are respectively filled with concrete (13) and expanded polymer (10) from top to down, an annular elastic diaphragm (7) is further connected to an inner wall of the pile shoes (2), and the expanded polymer (10) is wrapped by the elastic diaphragm (7), such that the expanded polymer (10) is isolated from the steel pipe piles (1) and the concrete (13).

2. The system for sealing expanded polymer-based pile shoes for the jacket according to claim 1, wherein a first sealing partitioning strip (14) and a second sealing partitioning strip (12) are arranged between each pile shoe (2) and each steel pipe pile (1) from top to bottom, the first sealing partitioning strip (14) and the second sealing partitioning strip (12) partition the gap between the pile shoe (2) and the steel pipe pile (1) into a first annular chamber (11) and a second annular chamber (6), the first annular chamber (11) is filled with the concrete (13), and the expanded polymer (10) and the elastic diaphragm (7) are arranged in the second annular chamber (6).

3. The system for sealing expanded polymer-based pile shoes for the jacket according to claim 1, wherein a sand-preventing diaphragm (9) is arranged at a bottom of each pile shoe (2), and the steel pipe pile (1) is inserted into the seabed (4) after perforating the sand-preventing diaphragm (9).

4. The system for sealing expanded polymer-based pile shoes for the jacket according to claim 3, wherein a bottom cover (200) is fixedly matched with the bottom of the pile shoe (2), and the sand-preventing diaphragm (9) is clamped between the pile shoe (2) and the bottom cover (200).

5. The system for sealing expanded polymer-based pile shoes for the jacket according to claim 1, wherein a grouting pipe (8) for grouting the expanded polymer (10) is arranged on a side portion of the pile shoe (2).

6. A method for sealing expanded polymer-based pile shoes for a jacket, the method comprising the steps of:

step S1, mounting an annular elastic diaphragm (7) on an inner wall of a pile shoe (2);

step S2, disposing a jacket (3) on a seabed (4), inserting a steel pipe pile (1) into the pile shoe (2) and then driving a lower end of the steel pipe pile (1) into the seabed (4);

step S3, grouting an expanded polymer (10) between the inner wall of the pile shoe (2) and the elastic diaphragm (7), wherein the expanded polymer (10) wrapped by the elastic diaphragm (7) expands, such that a barrier formed by the expanded polymer (10) and the elastic diaphragm (7) is formed between the pile shoe (2) and the steel pipe pile (1); and step S4, grouting concrete grout between the pile shoe (2) and the steel pipe pile (1) and above the expanded polymer (10), wherein the pile shoe (2) and the steel pipe pile (1) are fixedly connected after the concrete grout is solidified, thereby completing the installation of the jacket foundation.

7. The method for sealing expanded polymer-based pile shoes for the jacket according to claim 6, wherein in the step S1, a first sealing partitioning strip (14) and a second sealing partitioning strip (12) are further arranged on the inner wall of the pile shoe (2) and are respectively located at the upper and lower ends of the elastic diaphragm (7), the two sealing partitioning strips partition a gap between the pile shoe (2) and the steel pipe pile (1) into a first annular chamber (11) and a second annular chamber (6); in the step S2, the inner ends of the two elastic diaphragms (7) are tightly attached to the steel pipe pile (1) after the steel pipe pile (1) is inserted into the pile shoe (2); in the step S3, the expanded polymer (10) is grouted into the second annular chamber (6); and in the step S4, the concrete grout is grouted into the first annular chamber (11).

8. The method for sealing expanded polymer-based pile shoes for the jacket according to claim 7, wherein the side wall of the pile shoe (2) is provided with a grouting pipe (8) for grouting the expanded polymer (10), and the expanded polymer (10) extrudes residual seawater from the second annular chamber (6) through the grouting pipe (8) on the side wall of the pile shoe (2) while expanding underwater.

9. The method for sealing expanded polymer-based pile shoes for the jacket according to claim 6, wherein in the step S1, a sand-preventing diaphragm (9) is arranged at the bottom of the pile shoe (2), and in the step S2, the steel pipe pile (1) perforates the sand-preventing diaphragm (9) when being inserted into the pile shoe (2).

10. The method for sealing expanded polymer-based pile shoes for the jacket according to claim 6, wherein the jacket (3) is leveled after the steel pipe pile (1) is driven into the seabed (4), and then the method proceeds to the step S3.

* * * * *